United States Patent [19]

Kidder et al.

[11] Patent Number: 4,954,934

[45] Date of Patent: Sep. 4, 1990

[54] PURSE LIGHT

[76] Inventors: Stephen E. Kidder, P.O. Box 479, Roswell, N. Mex. 88201; George Spector, 233 Broadway Rm. 3815, New York, N.Y. 10007

[21] Appl. No.: 311,056

[22] Filed: Feb. 16, 1989

[51] Int. Cl.[5] ..... A45C 15/06

[52] U.S. Cl. ..... 362/156; 362/253

[58] Field of Search ..... 362/154, 156, 253, 396

[56] References Cited

U.S. PATENT DOCUMENTS 4,091,443 5/1978 Ohrenstein et al. ..... 362/156

4,654,763 3/1987 Knight ..... 362/156

*Primary Examiner*—Stephen F. Husar

[57] ABSTRACT

A purse light is provided and consists of a housing removably secured by hook and loop pile strips to interior surface of a purse so that a switch in an on position will activate a battery powered light bulb to illuminate the interior of the purse.

3 Claims, 1 Drawing Sheet

PURSE LIGHT

BACKGROUND OF THE INVENTION

The instant invention relates generally to battery powered flash lights and more specifically it relates to a purse light.

Numerous battery powered flash lights have been provided in prior art that are adapted to be used to illuminate the interior of pocketbooks for better visability therein. For example, U.S. Pat. Nos. 4,517,627; 4,638,412 and 4,654,763 all are illustrative of such prior art. While these units may be suitable for the particular purpose to which they address, they would not be as suitable for the purposes of the present invention as heretofore described.

SUMMARY OF THE INVENTION

A primary object of the present invention is to provide a purse light that will overcome the shortcomings of the prior art devices.

Another object is to provide a purse light that can be removably secured to interior of a purse so that it can be used from purse to purse.

An additional object is to provide a purse light in which the light bulb and battery can be quickly replaced therefrom.

A further object is to provide a purse light that is simple and easy to use.

A still further object is to provide a purse light that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
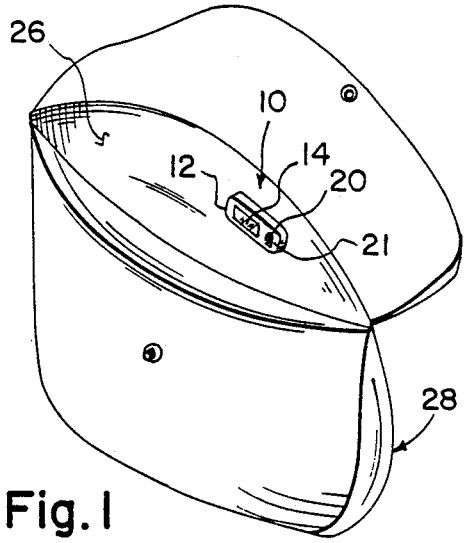
FIG. 1 is a perspective view of a pocket book with the invention installed therein.
Figure 4:
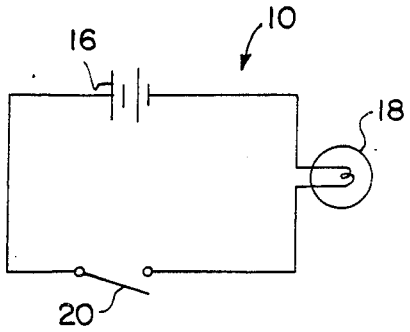
FIG. 4 is a schematic diagram of the electric circuit.
Figure 2:
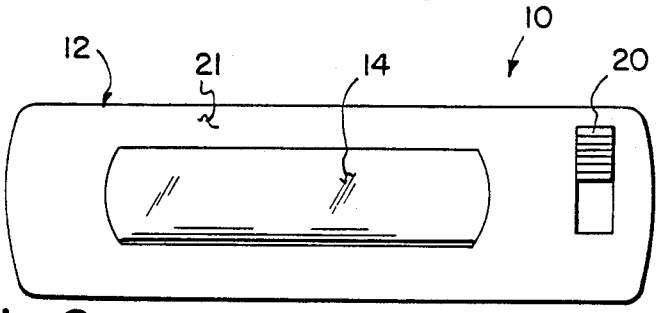
FIG. 2 is a front view of the invention.
Figure 3:
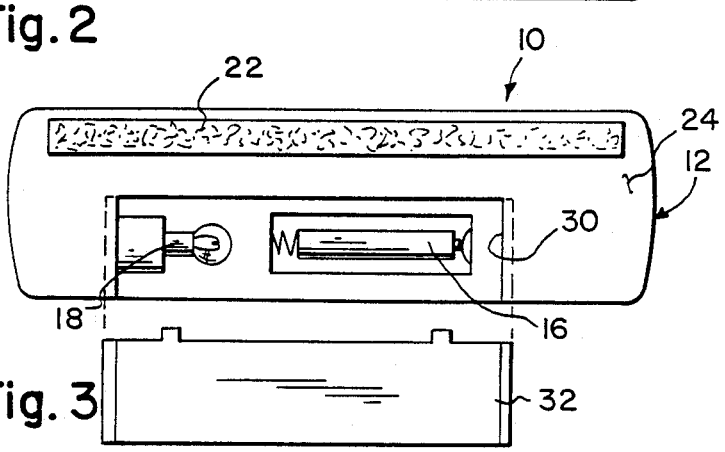
FIG. 3 is a rear view thereof with the sliding panel removed therefrom so that bulb and battery can be changed.

Turning now descriptively to the drawings, in which similar reference characters denote similar elements throughout the several views, FIGS. 1 through 4 illustrate a purse light 10 consisting of an elongated housing 12 that has a front lens 14 therein. A battery 16 and a light bulb 18 are both carried within the housing 12 in which the light bulb 18 is behind the lens 14 and is electrically connected to the battery 16. A switch 20 is carried on front 21 of the housing 12 and is electrically connected between the battery 16 and the light bulb 18 for turning the light bulb on and off. Hook and loop pile strips 22 are mounted to rear surface 24 of the housing 12 and interior surface 26 of a purse 28 so that when the switch 20 is in an on position the light bulb 18 will illuminate the interior surface 26 of the purse 28 through the front lens 14.

The housing 12 has a rear opening 30 therein so that a sliding panel 32 can fit within the rear opening 30 of the housing 12. A person (not shown) can gain access to the battery 16 and the light bulb 10 for quick replacement therefrom.

Figure 6:
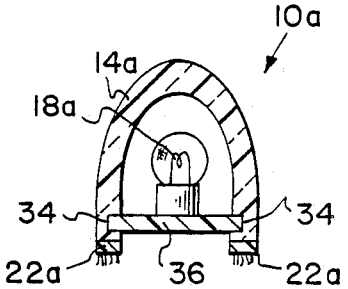
FIG. 6 is a cross sectional view taken along 6—6 in FIG. 5.
Figure 7:
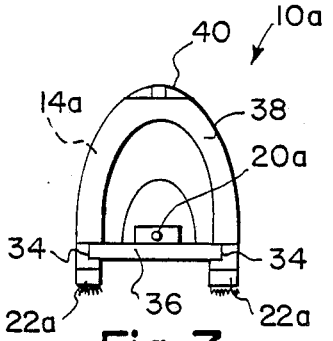
FIG. 7 is an end view taken in direction of arrow 7 in FIG. 5 showing one of the dome doors in greater detail.
Figure 5:
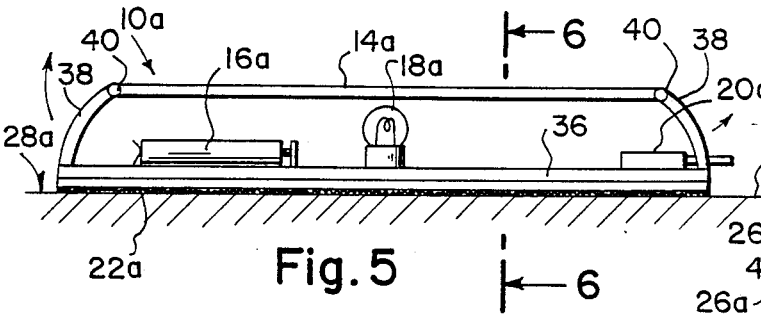
FIG. 5 is a top view of a modification in which a slideable base plate having the switch, bulb and battery thereon can be tongue and grooved to an elongated dome lens.
Figure 8:
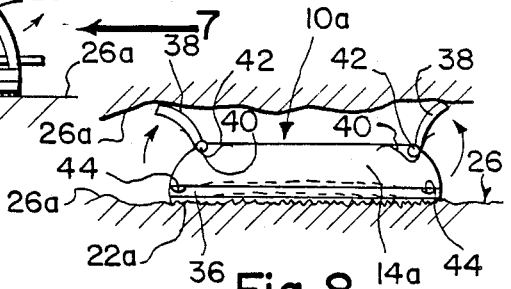
FIG. 8 is a top view looking down into an open pocket book showing the dome doors open and maintaining the pocket book in expanded position for viewing the interior thereof.

FIGS. 5 through 8 show a modified purse light **10*a* that consists of an elongated dome lens 14*a* that has a pair of parallel grooves 34 running along interior of open rear end thereof. A slideable base plate 36 fits as a tongue into the grooves 34. A battery 16*a* is carried on one end of the base plate 36 while a light bulb 18*a* is carried in middle of the base plate 36 and is electrically connected to the battery 16*a*. A toggle switch 20*a* is carried on other end of the base plate 36 and is electrically connected between the battery 16*a* and the light bulb 18*a* for turning the light bulb on and off. Hook and loop strips 22*a* are mounted to rear surface of the dome lens 14*a* and interior surface 26*a* of a purse 28*a* so that when the toggle switch 20*a* is in an on position the light bulb 18*a* will illuminate the interior surface 26*a* of the purse 28*a* through the dome lens 14*a***.

A dome door 38 is hinged to each upper side end 40 of the dome lens **14*a*. A coil spring 42 is carried on each hinged end 40 of the dome doors 38 so as to bias the dome doors into an open outward position to bear against interior surface 26*a* of the purse 28*a* in an expanded arrangement for viewing therein. The base plate 36 has a notch 44 formed on top surface at each end thereof so as to hold the dome doors 38** in a closed position.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A purse light which comprises:

(a) an elongated dome lens having a pair of parallel grooves running along interior of open rear end thereof;

(b) a slideable base plate to fit as a tongue into said grooves;

(c) a battery carried on one end of said base plate;

(d) a light bulb carried in middle of said base plate and electrically connected to said battery;

(e) a toggle switch carried on other end of said base plate and electrically connected between said battery and said light bulb for turning said light bulb on and off; and (f) means on rear of said dome lens for removably securing said dome lens to interior of a purse so that when said toggle switch is in an on position said light bulb will illuminate the interior of the purse through said dome lens.

2. A purse light as recited in claim 1, wherein said removable securing securing means includes hook and loop pile strips mounted to rear surface of said dome lens and the interior surface of the purse.

3. A purse light as recited in claim 2, further including:

(a) a pair of dome doors, each hinged to an upper side end of said dome lens;

(b) a pair of coil springs, each carried on hinged end of one of said dome doors so as to bias said dome door into an open outward position to bear against interior surface of the purse in an expanded arrangement for viewing therein; and (c) said base plate having a pair of notches, each formed on top surface of ends thereof so as to hold said dome doors in a closed position.

* * * * *